US006184181B1

(12) United States Patent
Lum et al.

(10) Patent No.: US 6,184,181 B1
(45) Date of Patent: Feb. 6, 2001

(54) PROCESS FOR CONTROLLING THE GLOSS OF A THERMAL DYE TRANSFER IMAGE

(75) Inventors: Kin K. Lum, Webster; Bruce C. Campbell; Maurice L. Gray, both of Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/303,522

(22) Filed: Apr. 30, 1999

(51) Int. Cl.[7] ..... B41M 5/20
(52) U.S. Cl. ..... 503/227; 428/320.2
(58) Field of Search ..... 8/471; 428/195, 428/320.2, 913, 914; 503/227

(56) References Cited

U.S. PATENT DOCUMENTS 3,556,934 1/1971 Meyer ..... 162/169
3,779,951 12/1973 Streu ..... 260/2.5 B
5,387,573 2/1995 Oldfield et al. ..... 503/227

*Primary Examiner*—Bruce H. Hess
(74) *Attorney, Agent, or Firm*—Harold E. Cole

(57) ABSTRACT

A process of controlling the gloss of a thermal dye transfer image comprising:

(a) imagewise-heating a dye-donor element comprising a support having thereon a dye layer comprising an image dye in a binder, the dye-donor being in contact with a dye-receiving element, thereby transferring a dye image to an image-receiving layer of the dye-receiving element to form the dye transfer image; and (b) thermally transferring a protection layer on top of the transferred dye image, the protection layer being applied from an element which contains unexpanded synthetic thermoplastic polymeric microspheres, the microspheres having a particle size in the unexpanded condition of from about 5 to about 20 $\mu$m, the protection layer being transferred using a given energy level in order to expand the microspheres until a desired gloss level is obtained.

8 Claims, No Drawings

PROCESS FOR CONTROLLING THE GLOSS OF A THERMAL DYE TRANSFER IMAGE

CROSS REFERENCE TO RELATED APPLICATION

Reference is made to commonly-assigned copending U.S. patent application Ser. No. 09/193,642, filed Nov. 18, 1998, Docket 78587HEC entitled "Dye-Donor Element With Transferable Protection Overcoat", of Lum et al.

FIELD OF THE INVENTION

This invention relates to a method for controlling the gloss of a thermal dye transfer image using expandable microspheres.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. This is due to dye being at the surface of the dye-receiving layer of the print. These dyes can be driven further into the dye-receiving layer by thermally fusing the print with either hot rollers or a thermal head. This will help to reduce dye retransfer and fingerprint susceptibility, but does not eliminate these problems. However, the application of a protection overcoat will practically eliminate these problems.

In a thermal dye transfer printing process, it is desirable for the finished prints to compare favorably with color photographic prints in terms of image quality. The look of the final print is very dependent on the surface texture and gloss. Typically, color photographic prints are available in surface finishes ranging from very smooth, high gloss to rough, low gloss matte. However, applying a thermal image to a rough surface would result in uniformity problems and drop-outs.

If a matte finish is desired on a thermal print, it has been previously been accomplished by using matte sprays or by matte surface applications through post printing processors. However, both of these solutions are costly and add a degree of complexity to the process.

U.S. Pat. Nos. 3,556,934 and 3,779,951 disclose the use of microspheres in a paper and subjecting it to temperatures sufficient to cause the particles to expand within the paper sheet. However, there is no disclosure in these patents of using such microspheres in a dye-donor element for a thermal dye transfer system.

U.S. Pat. No. 5,387,573 relates to the a dye-donor element with a transferable protection overcoat containing particles in order to reduce iridescence. However, there is a problem with these particles in that they do not appreciably roughen the receiver surface to reduce the image gloss.

It is the object of this invention to provide a process for controlling the gloss of a thermal dye transfer image.

SUMMARY OF THE INVENTION

This and other objects are achieved in accordance with this invention which relates to a process of controlling the gloss of a thermal dye transfer image comprising:

(a) imagewise-heating a dye-donor element comprising a support having thereon a dye layer comprising an image dye in a binder, the dye-donor being in contact with a dye-receiving element, thereby transferring a dye image to an image-receiving layer of the dye-receiving element to form the dye transfer image; and (b) thermally transferring a protection layer on top of the transferred dye image, the protection layer being applied from an element which contains unexpanded synthetic thermoplastic polymeric microspheres, the microspheres having a particle size in the unexpanded condition of from about 5 to about 20 $\mu$m, the protection layer being transferred using a given energy level in order to expand the microspheres until a desired gloss level is obtained.

During application of the protection layer to the receiver element, heat from the linear thermal printing head causes the microspheres to expand to many times their original size. This causes a roughening of the surface to occur resulting in a matte or lower gloss image comparable to that obtained on a matte surface photographic paper. By controlling the printing energy, a wide range of glosses can be created using the same donor ribbon.

DETAILED DESCRIPTION OF THE INVENTION

By use of the invention, a printer can be programmed to provide a given energy level during transfer of the protection layer. This energy level will correspond to a desired gloss level in the final print without changing the donor ribbon or receiver. Thus, the invention provides a very simple way to obtain different gloss levels in a thermal transfer print.

In general, the minimum energy level for transferring the protection layer is at least about 2.4 joules/cm$^2$. A preferred range for the energy level is from about 2.4 joules/cm$^2$ to about 3.6 joules/cm$^2$.

In a preferred embodiment of the invention, the dye-donor element employed in the process of the invention is a multicolor element comprising repeating color patches of yellow, magenta and cyan image dyes, respectively, dispersed in a binder, and a patch containing the protection layer.

In another embodiment of the invention, the protection layer is the only layer on the donor element employed and is used in conjunction with another dye-donor element which contains the image dyes.

In another preferred embodiment of the invention, the dye-donor element employed is a monochrome element and comprises repeating units of two areas, the first area comprising a layer of one image dye dispersed in a binder, and the second area comprising the protection layer.

In another preferred embodiment of the invention, the dye-donor element employed is a black-and-white element and comprises repeating units of two areas, the first area comprising a layer of a mixture of image dyes dispersed in a binder to produce a neutral color, and the second area comprising the protection layer.

Any expandable microspheres may be used in the invention such as those disclosed in U.S. Pat. Nos. 3,556,934 and 3,779,951 discussed above. In a preferred embodiment of the invention, the expandable microspheres are white, spherically-formed, hollow particles of a thermoplastic shell encapsulating a low-boiling, vaporizable substance, such as a gas, which acts as a blowing agent. When the unexpanded microspheres are heated, the thermoplastic shell softens and the encapsulated blowing agent expands, building pressure. This results in expansion of the microsphere. This results in expansion of the microsphere. Unexpanded microspheres have an initial average diameter of 6 to 35 $\mu$m (based on weight average) depending on grade. After expansion they reach average diameters of 20 to 120 $\mu$m.

The expandable microspheres employed in the invention may be formed by encapsulating propane, butane or any other low-boiling, vaporizable substance into a microcapsule of a thermoplastic resin such as a vinylidene chloride-acrylonitrile copolymer, a methacrylic acid ester-acrylonitrile copolymer or a vinylidene chloride-acrylic acid ester copolymer. These microspheres are available commercially as Expancel® Microspheres 551 DU, 461 DU, 551-20 DU and 461-20 DU (Expancel Inc.)

The amount of the microspheres employed in the invention ranges from about 10 to about 200% by weight of the polymer used in the protection layer. This coverage is from about 0.05 g/m$^2$ to about 1 g/m$^2$, preferably about 0.25 g/m$^2$ to about 0.5 g/m$^2$.

The present invention provides a protection overcoat layer on a thermal print by uniform application of heat using a thermal head. After transfer to the thermal print, the protection layer provides superior protection against image deterioration due to exposure to light, common chemicals, such as grease and oil from fingerprints, and plasticizers from film album pages or sleeves made of poly(vinyl chloride). The protection layer is generally applied at a coverage of at least about 0.05 g/m$^2$.

The transferable protection layer may comprise the microspheres dispersed in a polymeric binder. Many such polymeric binders have been previously disclosed for use in protection layers. Examples of such binders include those materials disclosed in U.S. Pat. No. 5,332,713, the disclosure of which is hereby incorporated by reference. In a preferred embodiment of the invention, poly(vinyl acetal) is employed.

In use, yellow, magenta and cyan dyes are thermally transferred from a dye-donor element to form an image on the dye-receiving sheet. The thermal head is then used to transfer the clear protection layer, from another clear patch on the dye-donor element or from a separate donor element, onto the imaged receiving sheet by uniform application of heat. The clear protection layer adheres to the print and is released from the donor support in the area where heat is applied.

Any dye can be used in the dye layer of the dye-donor element employed in the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

(magenta)

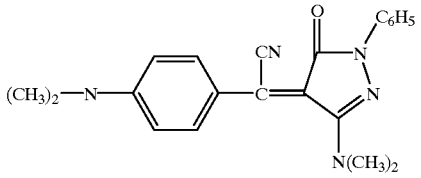

(yellow)

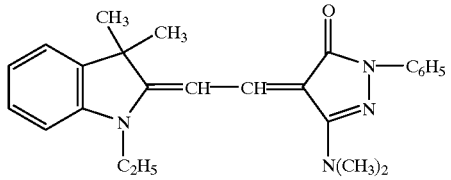

(yellow)

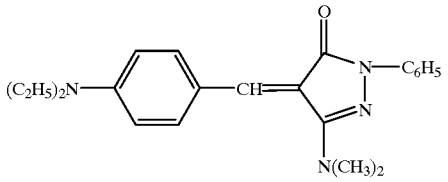

(cyan)

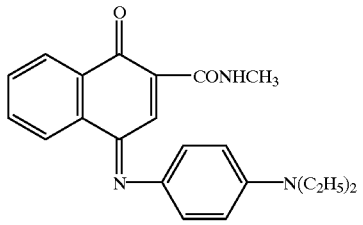

(cyan)

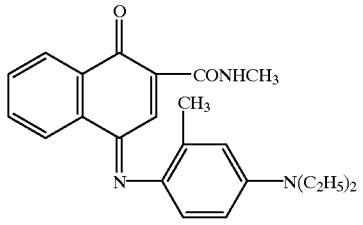

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements employed in the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element employed in the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, polycaprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 $g/m^2$. If a polymeric binder is employed, the lubricating material is present in the range of 0.05 to 50 weight %, preferably 0.5 to 40 weight %, of the polymeric binder employed.

Any material can be used as the support for the dye-donor element employed in the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

The dye-receiving element that is used with the dye-donor element employed in the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 $g/m^2$.

As noted above, the dye donor elements employed in the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element employed in the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage employed in the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

The following examples are provided to illustrate the invention.

EXAMPLES

Example 1

Element 1 of the Invention

Protection layer donor elements were prepared by coating on a 6 $\mu$m poly(ethylene terephthalate) support:

1) a subbing layer of titanium alkoxide (DuPont Tyzor TBT)® (0.12 $g/m^2$) from a n-propyl acetate and n-butyl alcohol solvent mixture, and 2) a slipping layer containing an aminopropyl-dimethyl-terminated polydimethylsiloxane, PS513® (Petrarch Systems, Inc.) (0.01 $g/m^2$), a poly(vinyl acetal) binder (0.38 g/m$^2$) (Sekisui KS-1), p-toluenesulfonic acid (0.0003 g/m$^2$) and candellila wax (0.02 g/m$^2$) coated from diethylketone.

The other side of the donor element was coated with a solution of poly(vinyl acetal) (0.54 g/m$^2$) (Sekisui KS-10), colloidal silica IPA-ST (Nissan Chemical Co.) ( 0.4 g/m$^2$), and Expancel® Microspheres 551 DU (Expancel Inc.) (0.32 g/m$^2$) in a solvent mixture of diethylketone and isopropyl alcohol (80:20).

Element 2 of the Invention

This element was prepared similar to Element 1 except that it contained 0.32 g/m$^2$ of the Expancel® Microspheres 551-20 DU.

Element 3 of the Invention

This element was prepared similar to Element 1 except that it contained 0.32 g/m$^2$ of the Expancel® Microspheres 461-20 DU.

Element 4 of the Invention

This element was prepared similar to Element 1 except that it contained 0.22 g/m$^2$ of the Expancel® Microspheres 461 DU and 0.16 g/m$^2$ of the Expancel® Microspheres 551-20 DU.

Control 1

A control element was prepared similar to Element 1, except that instead of microspheres, it contained divinylbenzene beads (4 $\mu$m) in an amount of 0.10 g/m$^2$.

A thermal dye-transfer receiving element was prepared by coating the following layers in order onto a support of an OPPalyte® polypropylene laminated paper support as described in U.S. Pat. No. 5,244,861:

a) a subbing layer of Prosil® 221 (aminopropyltriethoxysilane) and Prosil® 2210 (aminofunctional epoxysilane) (PCR, Inc.) (1:1 weight ratio) and LiCl (0.0022 g/m$^2$) in an ethanol-methanol-water solvent mixture. The resultant solution (0.10 g/m$^2$) contained approximately 1% of silane component, 3% water, and 96% of 3A alcohol;

b) a dye-receiving layer containing Makrolon® KL3-1013 (a polyether-modified bisphenol-A polycarbonate block copolymer (Bayer AG) (1.52 g/m$^2$), Lexan® 141-112 bisphenol-A polycarbonate (General Electric Co.) (1.24 g/m$^2$), Fluorad® FC-431 a perfluorinated alkylsulfonamidoalkylester surfactant (3M Co.) (0.011 g/m$^2$), Drapex® 429 polyester plasticizer (Witco Corp.) (0.23 g/m$^2$), 8 $\mu$m crosslinked poly(styrene-co-butyl acrylate-co-divinylbenzene) elastomeric beads (Eastman Kodak Co.) (0.006 g/m$^2$) and diphenyl phthalate (0.46 g/m$^2$) coated from dichloromethane; and c) a dye-receiver overcoat coated from a solvent mixture of methylene chloride and trichloroethylene containing a polycarbonate random terpolymer of bisphenol-A (50 mole-%), diethylene glycol (49 mole-%), and polydimethylsiloxane (1 mole-%) (2,500 MW) block units (0.55 g/m$^2$); a bisphenol A polycarbonate modified with 50 mole-% diethylene glycol (2,000 MW) (0.11 g/m$^2$); Fluorad® FC-431 surfactant (0.022 g/m$^2$); and DC-510 ® surfactant (Dow Corning Corp.) (0.003 g/m$^2$).

Polycarbonates used:

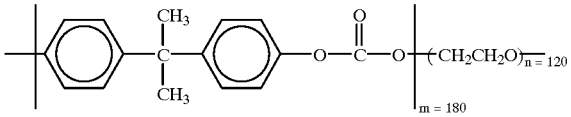

KL3-1013, block copolymer of polyether glycol and bisphenol A polycarbonate (Bayer AG)

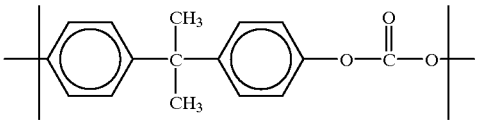

Bisphenol A polycarbonate Lexan 141® (General Electric Company)

Printing

The transfer of the protection layer of the donor element described above was carried out in a printing device similar to the commercially-available Kodak XLS-8650 Printer. It was equipped with a TDK Thermal Head (No. 3K0345) which had a resolution of 300 dpi and an average resistance of 3314 ohm. The printing speed was 5 ms per line. The head voltage was set at 13.6v to give a maximum printing energy of approximately 3.55 joules/cm$^2$ at 36.4° C.

The protection layer was printed on the receiving element without any image dye. At a set head voltage the energy used to do the lamination is determined by the time the heating elements of the print head are turned on, which in turn is modulated by the number of pulses and it's enable width. In this experiment, the number of pulses were constant and the enable width was varying to yield different energy levels for the lamination process. The energy was calculated according to the following equation:

$$E=P\times Ena\times N\times H\times L/A$$

where

E=Energy joules/cm$^2$)

P=Power=V$^2$/R

Ena=Enable Width (seconds)

N=Number of Pulses

H=Number of Heating Elements

L=Number of Lines to Print

A=Printed Area (cm$^2$)

The surface gloss of each print was measured with a Gardner Micro-Tri-Gloss meter according to the ASTM Standard Test Method for Specular Gloss (D 523-89). Surface roughness and peaks per centimeter measurements were made by the ANSI/ASME B46.1-1985 test on page 30, Sect. C3.1.1, described in the "1985 Catalog of American National Standards", published by the American Society of Mechanical Engineers jointly with the American National Standards Institute); United Engineering Center, 345 E. 47th Street, New York, N.Y. 10017. The definition for Ra (Roughness average) and um-AA (Arithmetic Average) is also described in the above article. The following results were obtained:

TABLE

| Element | Printing Energy (joules/cm$^2$) | 60 degree gloss | Roughness Average (Ra)($\mu$m) | Peaks/cm (1 $\mu$m filter) |
|---|---|---|---|---|
| Control 1 | 1.986 | 76.6 | 0.11 | 1 |
| Control 1 | 2.483 | 77.0 | 0.10 | 0 |
| Control 1 | 2.979 | 76.7 | 0.10 | 0 |
| Control 1 | 3.476 | 74.5 | 0.11 | 3 |
| 1 | 1.986 | 74.9 | 0.18 | 18 |
| 1 | 2.483 | 70.0 | 0.20 | 19 |
| 1 | 2.979 | 62.3 | 0.30 | 46 |
| 1 | 3.476 | 52.5 | 0.50 | 78 |

TABLE-continued

| Element | Printing Energy (joules/cm$^2$) | 60 degree gloss | Roughness Average (Ra)($\mu$m) | Peaks/cm (1 $\mu$m filter) |
|---|---|---|---|---|
| 2 | 1.986 | 75.0 | 0.16 | 5 |
| 2 | 2.483 | 66.6 | 0.23 | 21 |
| 2 | 2.979 | 59.4 | 0.32 | 65 |
| 2 | 3.476 | 37.1 | 0.51 | 120 |
| 3 | 1.986 | 72.6 | 0.15 | 5 |
| 3 | 2.483 | 67.4 | 0.19 | 16 |
| 3 | 2.979 | 59.5 | 0.25 | 49 |
| 3 | 3.476 | 41.0 | 0.45 | 103 |
| 4 | 1.986 | 68.4 | 0.22 | 23 |
| 4 | 2.483 | 58.7 | 0.29 | 40 |
| 4 | 2.979 | 49.8 | 0.37 | 81 |
| 4 | 3.476 | 33.1 | 0.58 | 130 |

The above results show that the elements in accordance with the invention enable one to provide a range of gloss levels in a final print which is dependent upon the energy supplied from the print head to the protection layer during transfer. As the roughness average and peaks/cm increase, the gloss level decreases. This is in contrast to the control element which did not appreciably vary in any of these measurements as a function of energy level.

The invention has been described in detail with particular reference to preferred embodiments thereof, but it will be understood that variations and modifications can be effected within the spirit and scope of the invention.

What is claimed is:

1. A process of controlling the gloss of a thermal dye transfer image comprising:

(a) imagewise-heating a dye-donor element comprising a support having thereon a dye layer comprising an image dye in a binder, said dye-donor being in contact with a dye-receiving element, thereby transferring a dye image to an image-receiving, layer of said dye-receiving element to form said dye transfer image; and (b) thermally transferring a protection layer on top of said transferred dye image, said protection layer being applied from an element which contains unexpanded synthetic thermoplastic polymeric microspheres, said microspheres having a particle size in the unexpanded condition of from about 5 to about 20 $\mu$m, said protection layer being transferred using a given energy level in order to expand said microspheres until a desired gloss level is obtained.

2. The process of claim 1 wherein said energy level is at least about 2.4 joules/cm$^2$.

3. The process of claim l wherein said energy level is from about 2.4 joules/cm$^2$ to about 3.6 joules/cm$^2$.

4. The process of claim I wherein said microspheres are present at a coverage of about 0.05 g/m$^2$ to about 1 g/m$^2$.

5. The process of claim 1 wherein said microspheres comprise a vinylidene chloride-acrylonitrile copolymer, a methacrylic acid ester-acrylonitrile copolymer, or a vinylidene chloride-acrylic acid ester copolymer.

6. The process of claim 1 wherein said microspheres comprise a outer shell of a vinylidene chloride-acrylonitrile copolymer, a methacrylic acid ester-acrylonitrile copolymer or a vinylidene chloride-acrylic acid ester copolymer, and a core of a low boiling, vaporizable substance.

7. The process of claim 6 wherein said shell is a vinylidene chloride-acrylonitrile copolymer and said low boiling, vaporizable substance is propane or butane.

8. The process of claim I wherein said dye-donor element is a multicolor element comprising repeating color patches of yellow, magenta and cyan image dyes, respectively, dispersed in a binder, and a patch containing said protection layer.

* * * * *